United States Patent [19]

Gieske et al.

[11] Patent Number: 4,722,147

[45] Date of Patent: Feb. 2, 1988

[54] DISPLAY PANEL

[76] Inventors: Detlef J. Gieske, 232 Weisenberger, Houston, Tex. 77022; Daivd B. Kawchak, 2767 Briargrove #D552, Houston, Tex. 77057

[21] Appl. No.: 808,421

[22] Filed: Dec. 12, 1985

[51] Int. Cl.[4] ..... G09F 7/02

[52] U.S. Cl. ..... 40/618; 40/622

[58] Field of Search ..... 40/618, 622, 5, 22, 40/20

[56] References Cited

U.S. PATENT DOCUMENTS

| | | | |
|---|---|---|---|
| 351,862 | 11/1886 | Grosjean | 40/618 |
| 364,895 | 6/1887 | Cannon et al. | 40/618 |
| 454,769 | 6/1891 | Roberts | 40/622 |
| 533,915 | 2/1895 | Petry | 40/618 |
| 841,291 | 1/1907 | Weeks | 40/618 |
| 1,305,121 | 5/1919 | Klimowicz | 40/618 |
| 2,745,201 | 5/1956 | Guispeppe et al. | 40/618 |
| 2,964,859 | 12/1960 | Storer | 40/618 |
| 2,966,754 | 1/1961 | Orkin | 40/618 |

*Primary Examiner*—John J. Wilson
*Assistant Examiner*—Wenceslao J. Contreras
*Attorney, Agent, or Firm*—Dula, Shields & Egbert

[57] ABSTRACT

A display panel comprising a substantially planar structural layer of rigid material, a plurality of slats fastened to the structural layer, and a fastener for attaching the structural layer to a wall. The slats have a first surface that fastens flush against the structural layer. The slats also have a substantially planar second surface opposite the first surface. A horizontal slot is defined by the area between adjacent slats. A dado slot is formed within each of the slats and extends upwardly transverse to the horizontal slot and communicates with the horizontal slot. The fastener is a cleat which is fixedly attached to the side of the structural layer opposite the slats. The cleat has an angle cut along its lower edge.

4 Claims, 6 Drawing Figures

DISPLAY PANEL

TECHNICAL FIELD

The present invention relates to panels for the display of objects. more particularly, the present invention relates to portable panels that can be used to display merchandise, signs, or other objects.

BACKGROUND ART

In the setting of department stores, the display of merchandise often becomes a critical concern. Some merchandise may sell more rapidly in one location of a store than in another location. The introduction of new products for sale also creates problems as to the proper manner for displaying these products. In many instances, the inability to properly display merchandise can determine the success or failure of the product being offered for sale. Ultimately, this can reflect on the profitability of the store offering this merchandise for sale.

In the past, merchandise has been offered for sale from racks, fixtures, hangars, shelves, peg boards, and the like. Fixtures are often permenently embedded into the store. Racks are often unmovable or, at least, difficult to rearrange. Throughout virtually all department stores, shelves remain as shelves throughout the life of the store, racks remain as racks throughout the life of the store, and very little flexibility, interchangeability, or adaptability occurs.

A recent innovation in the field of fixturing for stores has been the use of slatwalls. Slatwalls accomodate a wide variety of slatwall hardware. This means that various types of hangars can be interchangeably introduced to the slatwall fixture. Unfortunately, slatwall fixtures are generally permanently affixed to the walls of the store, or generally unsuitable for shelving, and present a relatively unattractive visual appearance within the stores.

It is an object of the present invention to provide a display panel that is suitable for the receipt of shelving and slatwall hardware and accessories.

It is another object of the present invention to provide a display panel that is easily movable from one wall to another within a store.

It is another object of the present invention to provide a display panel that can receive signs.

It is still a further object of the present invention to provide a display panel that may be uniformly manufactured and relatively easily installed.

It is still a further object of the present invention to provide a display panel that is aesthetically attractive.

These and other objects and advantages of the present invention will become apparent from a reading of the attached specification and appended claims.

SUMMARY OF THE INVENTION

The present invention is a display panel comprising a substantially planar structural layer of rigid material; a plurality of slats fastened to the structural layer; and fasteners for removably attaching the display panels to an adjacent surface. The slats of the present invention have a first surface that fastens flush against the structural layer. The slats have a substantially planar surface opposite the first surface. The area between each of the slats defines a horizontal slot. A dado slot extends upwardly transverse to the horizontal slot within the slats.

Fasteners are attahced to the side of the structural layer opposite the slats.

The slats of the present invention comprise blocks of solid wood fastened to the structural layer. These blocks have a dado slot formed about the edge of the blocks which extends longitudinally along the block. A face piece is fastened to the side of the block opposite the structural layer. The face piece has a shape that corresponds to the shape of the block without the dado slot. A flexible material, such as cloth, vinyl, VELCRO, synthetic materials which adhere when pressed together, laminants, or other materials are fixedly fastened to the exterior surface of the slats. VELCRO-receiving material may be used for receiving objects having VELCRO-tape, or VELCRO-like tape, attached thereto. This flexible material is received by the dado slot.

A strip of VELCRO-like material is fastened to the structural layer at the area of the horizontal slot. This VELCRO-like material is for fixing the horizontal movement of an object, such as a shelf, placed into the horizontal slot. The fastener of the present invention is a cleat that is fixedly attached to the side of the structural layer opposite the slats. This cleat has an angle cut along its lower edge. This angle cut serves to engage a complementary angle cut in a support structure. This angle cut extends along the entire length of the cleat. The complementary angle-cut cleat is of the type that may be fixedly fastened to an interior wall or support structure, of an enclosure. Such an enclosure may be a department store. The cleat on the display panel slidably engages and is gravity-maintained within the complementary cleat.

Alternatively, the slats may comprise a first wood block fastened to the structural layer and a second wood block fastened to the structural layer. Each of these wood blocks is spaced a distance from the other blocks. The second wood block has the dado slot formed in its lower edge. The area between the first and second wood blocks may be used for receiving telephone cable or electrical lines, or may be used to reduce the overall weight of the display panel.

BEST MODE FOR CARRYING OUT THE INVENTION

Figure 1:
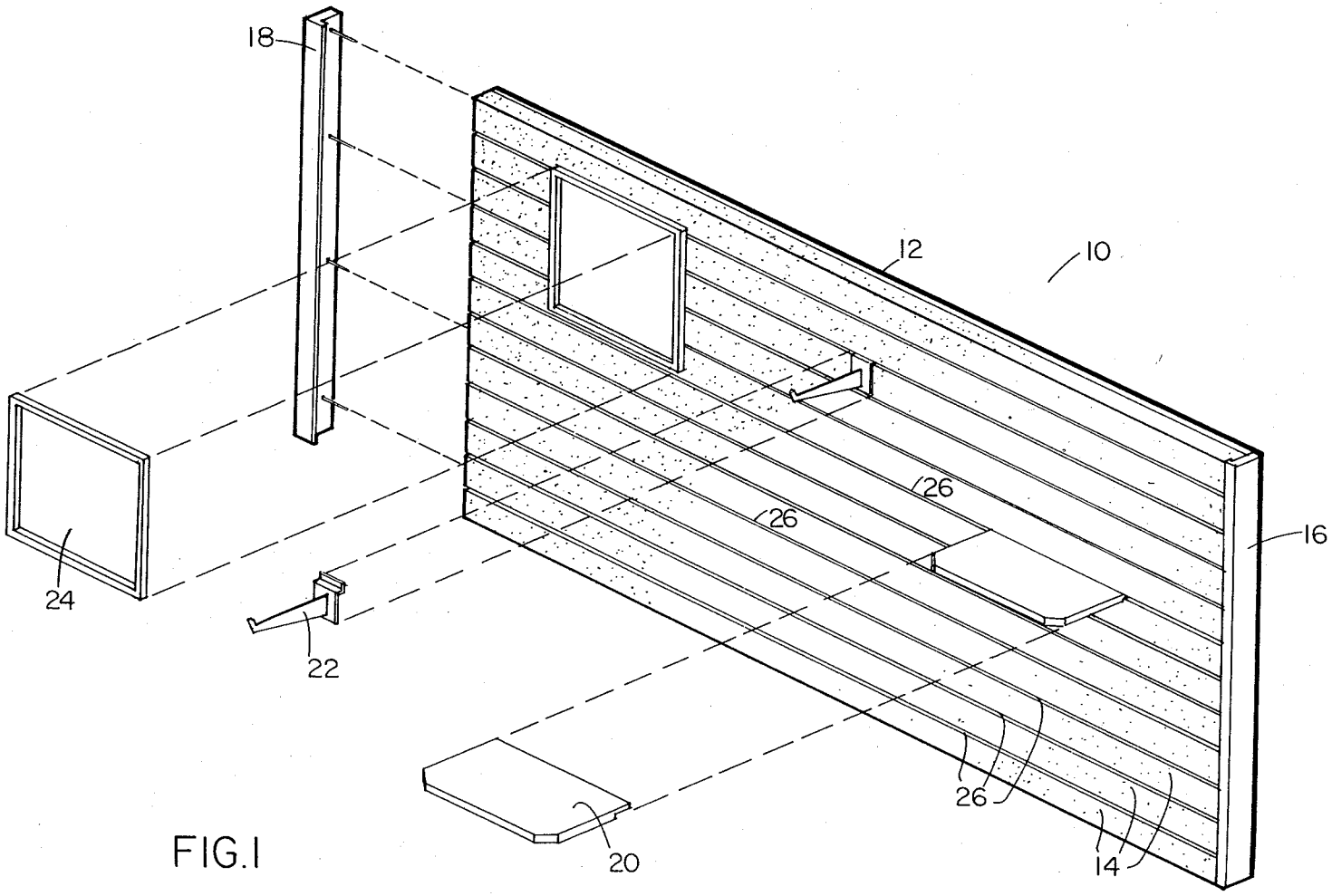
FIG. 1 is a perspective view of the display panel of the present invention.

Referring to FIG. 1, there is shown at 10 the display panel in accordance with the present invention. Display panel 10 has planar structural layer 12, slats 14, end caps 16 and 18, shelf 20 slatwall hanger 22, and sign 24. FIG.

1 shows the accessories 20, 22, and 24 fastened to display panel 10.

As shown in FIG. 1, slats 14 are fastened to structural layer 12. Each of the slats 14 has a length generally equal to the length of the structural layer. Each of the slats 14 also has a width generally equal to a fraction of the width of the structural layer. As shown in FIG. 1, there are twelve slats 14. The area between the slats 14 defines horizontal slots 26. These horizontal slots 26 extend for the length of the structural layer. In FIG. 1, shelf 20 slidably engages a horizontal slot 26. Slatwall hanger 22 is also received by a slot 26. However, it should be noted, that horizontal slot 26 does not totally receive slatwall hanger 22. A dado slot (to be described hereinafter) serves to properly receive the slatwall hanger 22. Sign 24 is removably affixed to the exterior surface of slats 14. End cap 16 is fastened to one end and along the side of the structural layer 12 and the slats 14. The second end cap 18 is fastened to the opposite end and along the side of structural layer 12 and the slats 14. End cap 16 and 18 are nailed to their respective ends.

Figure 2:
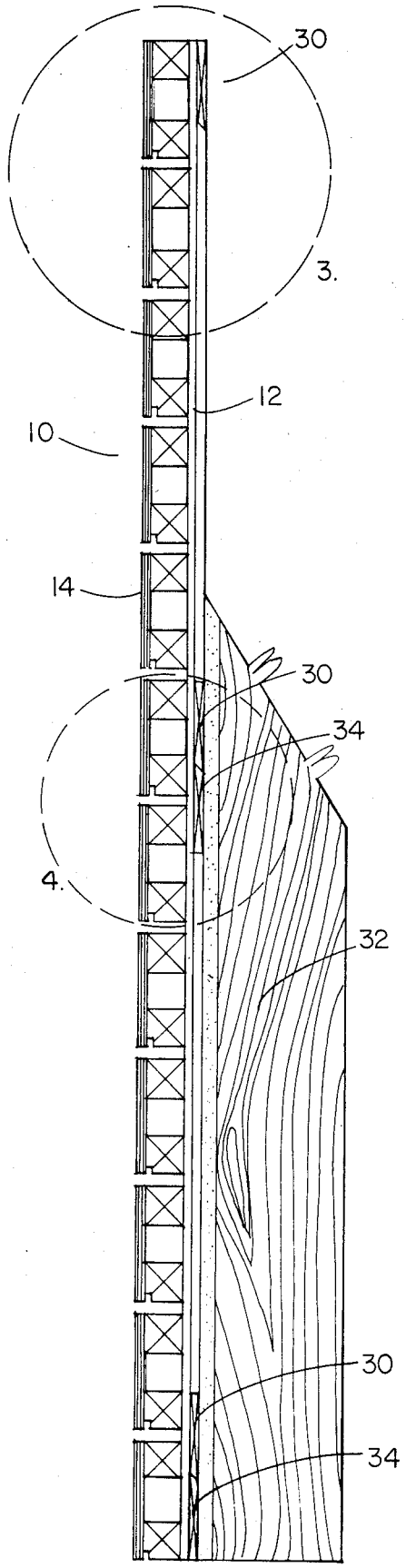
FIG. 2 is cross-sectional view of the mounted display panel of the present invention.

FIG. 2 is a cross-sectional view of the display panel 10 of the present invention. As shown in FIG. 2, cleats 30 are fastened to the side of the structural layer 12 opposite the slats 14. FIG. 2 also shows the display panel 10 as removably attached to wall 32. Wall 32 can be any wall on the interior of an enclosure. Wall 32 has complementary cleats 34 rigidly affixed thereon. Complementary cleats 34 serve to connect display panel 10 to wall 32.

Figure 3:
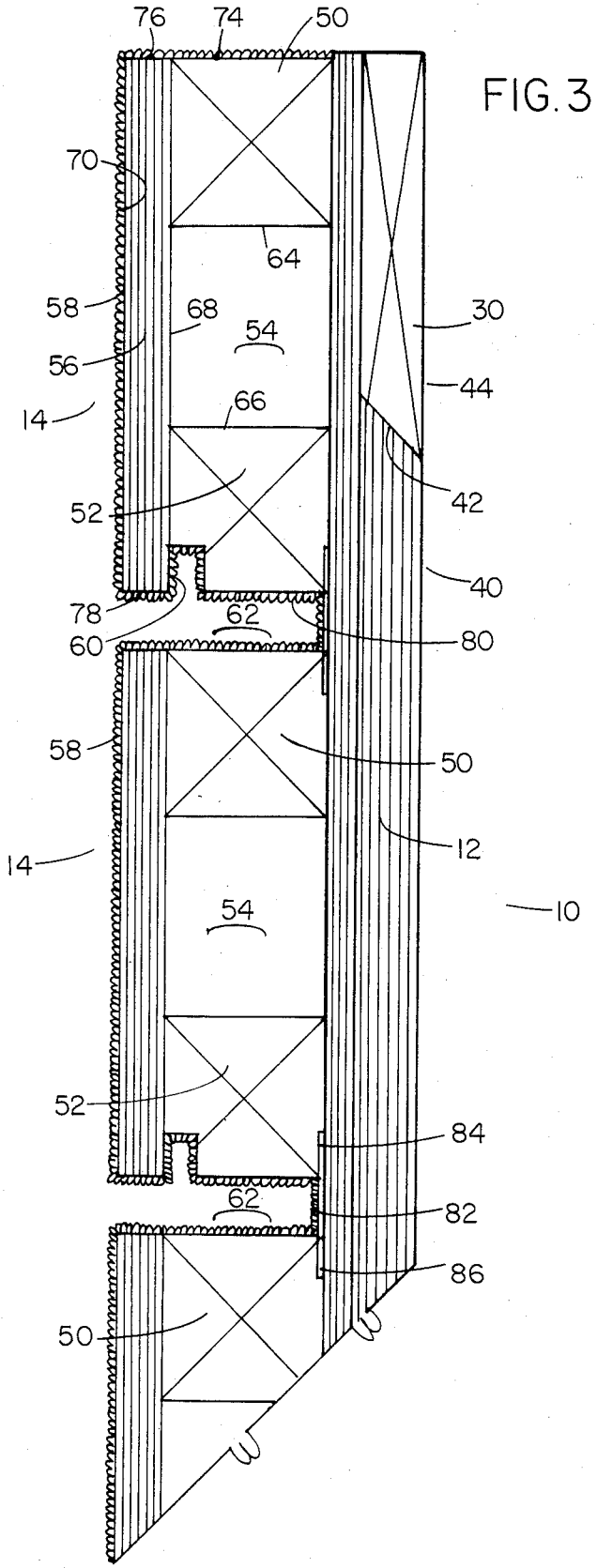
FIG. 3 is a close-up view of the circled area 3 of FIG. 2.

FIG. 3 is a close-up view of the circled ares 3 of FIG. 2. FIG. 3 shows, in detail, cleat 30, structural layer 12, and slats 14. Structural layer 12 is substantially planar layer of rigid material. As used in the preferred embodiment, structural layer 12 may be made of plywood or masonite.

Cleat 30 is a solid piece of wood that is rigidly fastened to surface 40 and structural layer 12. Cleat 30 may be attached by stapling and gluing or by any other means. Cleat 30 has a 45 degree angle cut 42 along its bottom edge. Angle cut 42 tapers from the outer edge 44 inwardly toward surface 40 of structural layer 12.

Slats 14 are depicted in much greater detail in FIG. 3. In particular, slats 14 comprise first wood block 50, second wood block 52, cavity 54, and face piece 56. A flexible material 58 is fixedly attached to the exterior surface of slats 14. First wood block 50 is a generally square or rectangular piece of solid wood which is fastened to structural layer 12. Although block 50 is preferrably manufactured from wood, it is believed that plastic, aluminum tubing, or other types of fill materials could serve the purpose of wood block 50. Wood block 50 is glued and stapled to the surface of structural layer 12. Block 50 extends for the length of the structural layer 12.

Second wood block 52 is fixedly attached to structural layer 12. Block 52 is spaced a distance from block 50. This distance defines cavity 54. Second block 52 is comprised of solid wood, such as a scrub grade of mohagany, or could be made of plastic, or other types of fill material. Importantly, however, block 52 must have a dado slot 60 formed along the lower edge of the block 52. Dado slot 60 is formed so as to communicate with horizontal slot 62. Dado slot 60 has a height of between $\frac{3}{8}$ inch and $\frac{5}{8}$ inch and a width of between $\frac{1}{4}$ inch and $\frac{3}{8}$ inch. The purpose of dado slot 60 is to receive the lip portion of slatwall accessories 22. This receiving type of arrangement is shown in greater detail in FIG. 5. Dado slot 60 extends upwardly transverse to horizontal slot 62. Block 52 defines two of the surfaces of dado slot 60. Face piece 56 defines the other surface of dado slot 60.

Cavity 54 is defined by the area between the lower surface 64 of block 50, the upper surface 66 of block 52, and the inner surface 68 of face piece 56. Cavity 54 is included to reduce the weight of the overall display panel 10. Cavity 54 may also be used to accept electrical conduit, telephone cable, or other appliances into the display panel 10. For example, it may be determined that it would be desirable to have a telephone attached to the exterior of display panel 10. Proper holes could be drilled through the material 58, the face piece 56 and the end caps 16 or 18 so as to allow the telephone cable to extend through cavity 54. Cavity 54 extends along the length of the structural layer 12.

It should be noted for the purposes of description that blocks 50 and 52 could have the same shape. In other words, block 50 could have a dado slot formed along one of its edges. The shape of block 50 only requires that its support face piece 56 an appropriate distance from structural layer 12. The shape of block 50 is only important in terms of economy of manufacture. Also, blocks 50 and 52 could be the same piece of wood. If weight factor was of little or no consideration, then blocks 50 and 52 could be the same block with cavity 54 eliminated. Still further, alternatively, cavity 54 could be drilled, or otherwise formed from the solid piece of wood making up blocks 50 and 52.

Face piece 56 is a substantially planar layer of rigid material fixedly fastened to the side of blocks 50 and 52 opposite structural layer 12. Face piece 56 has a planar outer surface 70. Material 58 is fastened to outer surface 70. Face piece 56 has a shape that corresponds to the exterior shape of blocks 50 and 52 without the dado slot. In other words, face piece 56 has a lower edge extending downwardly so as to be generally level with the lower edge of block 52. This lower portion of face piece 56 defines a wall of dado slot 60. Face piece 56 may be made of plywood, particle board or masonite. In the preferred embodiment, face piece 56 is glued and stapled or hot glued and screwed to blocks 50 and 52. Face piece 56 extends parallel to structural layer 12.

Flexible material 58 fits around the exterior surfaces of slats 14. In particular, flexible material 58 is a single piece of material that extends over the top of the slat 14 defined by surface 74 of first block 50, the top surface 76 of face piece 56, the planar exterior surface 70 of face piece 56, the bottom portion 78 of face piece 56, the interior walls of dado slot 60, and the bottom surface 80 of the second block 52. Material 58 can be fitted over this exterior surface in several ways. The preferred embodiment is to spray glue or cement over these surfaces and then rap the material over the surfaces. If contact cement is used, then it may be necessary to spray the backside of material 58 and the exterior surface of slat 14.

Material 58 may be used as decoration or as a functional material. Cloths, vinyls, laminants, and veneers may be the flexible material 58. Alternatively, the exterior surface of display board 10 can be made functional by fitting a VELCRO-material over this exterior surface. Virtually any fabric could be applied and used as the VELCRO-receiving material. By using such a material, objects having VELCRO-tape applied to the object's backside will be attachable to the outer, exterior surface of display board 10. In this manner, signs, pictures, or other displays can be readily attached to the exterior surface of the display board. FIG. 1 shows sign 24 fastened to the surface of display board 10 in such a manner.

An important feature of the present invention is the inclusion of VELCRO-type material 82 on the side of structural layer 12 opposite cleat 30. This VELCRO material is placed at the bottom of slot 62. In the preferred embodiment, the VELCRO-type material 81 has edges 84 and 86 extending therefrom. Edge 84 is interposed between second block 52 of slat 14 and the surface of structural layer 12. Similarly, edge 86 is fitted between the upper block 50 and the surface of structural layer 12. This serves to maintain the VELCRO material 82 in proper position at the end of horizontal slot 62. The VELCRO-type material 82 serves to fix the end of a shelf placed in horizontal slot 62 and to prevent the shelf from being easily removed from slot 62. VELCRO material 82 will engage a corresponding material on the edge of a shelf placed in the horizontal slot 62. The inclusion of flexible material 58 throughout horizontal slot 62 further strengthens the fit of the shelf 20 within slot 62 and to facilitate the guidance of the shelf 20 into such a slot.

Alternatively, VELCRO-type material 82 may be a strip of VELCRO-type material without edge portions 84 and 86. In this manner, VELCRO-type material 82 can be fastened to the bottom of horizontal slot 62 by an adhesive applied to the back of the VELCRO-type material 82.

Figure 4:
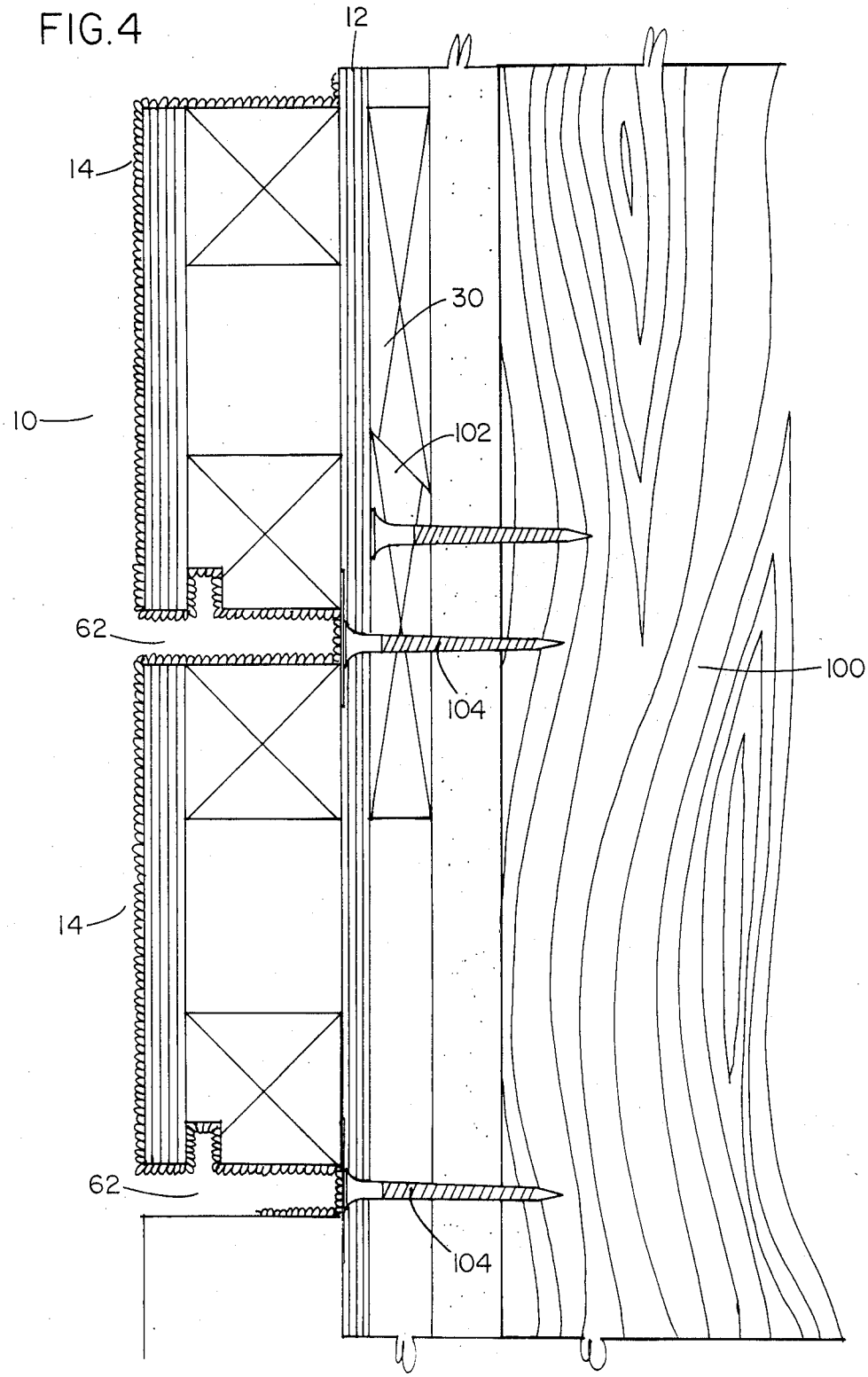
FIG. 4 is a close-up view of the circled area 4 of FIG. 2 showing, in addition, the use of screws to fix the display panel in position against a wall.

FIG. 4 shows a close-up view of the display board 10 as maintained in position adjacent a wall 100. FIG. 4 also shows the manner in which the cleat 30 engages a complementary cleat 102 affixed to wall 100. Complementary cleat 102 has an angle cut about the top lengthwise edge of cleat 102 which fits into an angle cut of cleat 30. In particular, cleat 102 has a 45 degree angle cut in which the taper is from the top of the cleat downwardly toward the wall 100. Display panel 10 is fastened to wall 100 by lowering cleat 30 onto the angle cut of complementary cleat 102. The angle of cut serves to properly position display panel 10 against wall 100, to retain display panel 10 in position, and to prevent display panel 10 from accidental dislodgment from wall 100. A proper vertical lifting force is required to remove cleat 30 from cleat 102.

Cleat 102 is fastened to wall 100. Cleat 102 maybe screwed, bolted, glued, or otherwise affixed to wall 100. The only significant requirement is that complementary cleat 102 be attached with sufficient strength to withstand the weight of display panel 10. If, after installation, it is found that the attachment force between the cleats and either display panel 10 or wall 100 is insufficient, then horizontal slots 62 allow screws 104 and 106 to be introduced to wall 100. Screw 104 can be inserted through slot 62, and threaded or self-taped into wall 100. Because of the arrangement of slot 62, an appropriate tightening device, such as a screwdriver, can be inserted and utilized through slot 62. Screw 104 passes through cleat 30 and into wall 100. This serves to increase the fastening force between cleat 30 and structural layer 12. Screw 108 is inserted directly into wall 100. In this manner, the present invention would facilitate the semi-permanent mounting of the display panel 10 adjacent wall 100.

Alternatively, screws 104 and 106 can be replaced by alternative devices. These alternative devices could include nails or bolts.

Figure 5:
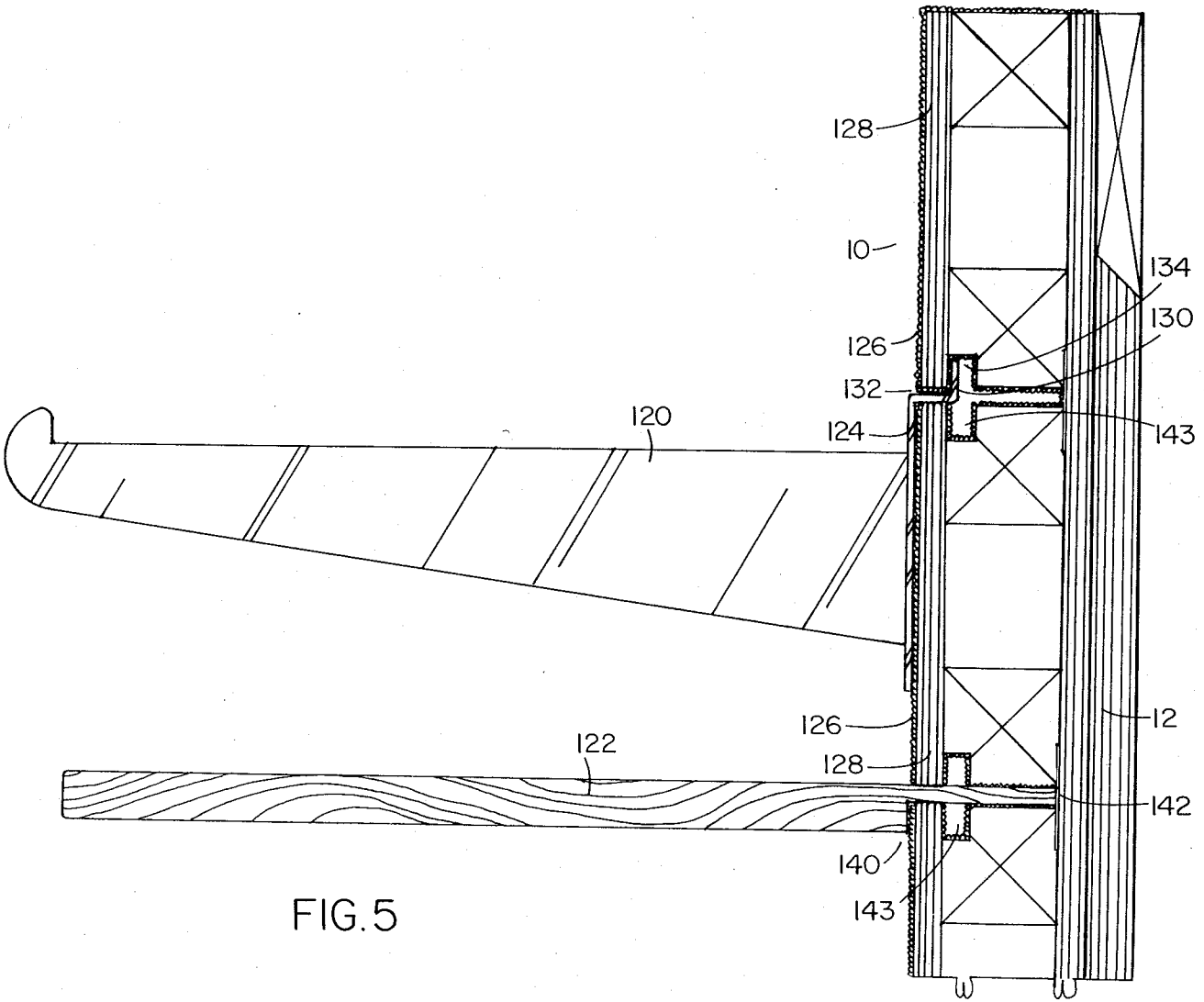
FIG. 5 is a cross-sectional view in side elevation of the display panel of the present invention showing its use in combination with slatwall accessories and shelving.

FIG. 5 shows has display panel 10 receives the slatwall accessory 120 and the shelf 122. The slatwall accessories come in a virtually infinite variety of apparatus. Slatwall accessory 120 is a hanger. Slatwall accessory 120 has a generally flat portion 124 which fits flush against the material 126. The juxtaposition of the flat portion 124 against material 126 and face piece 128 provides most of the support for items hung on hanger 120. A lip 130 extends horizontally outwardly from flat portion 124 and abuts the bottom of slot 132. Lip 130 has a upwardly vertically extending portion which abuts the wall of dado slot 134. Thus, display panel 10 is adapted to properly receive those hardware, brackets,, accessories, and appliances that would otherwise be suitable for present day slatwall.

Display panel 10 is also suitable for receiving shelf 122. Shelf 122 is a relatively flat board having a width of approximately $\frac{3}{8}$ inch. Shelf 122 slides through slot 140 in a tight-fitting fashion. The end 142 of shelf 122 abuts the structural layer 12 and becomes attached by way of the VELCRO-type material, mentioned previously. The interaction of the material 126 with the fit of slot 140 and VELCRO-type material retains shelf 122 in its horizontal outwardly extending position.

FIG. 5 also shows an alternative embodiment of the present invention in which a second dado slot 143 is formed in the slats on the opposite side of horizontal slot 132 from first dado slot 134. The second dado slot 143 can be used to accomodate a wider variety of slatwall devices. It can also make the display panel 10 reversible prior to mounting to cleats 30. The is modification also permits the panel to be mounted vertically. Certain types of slatwall accessores have a T-shaped bracket. The T-shaped bracket would attach to slots extending vertically (rather than horizontally) and support the slatwall accessory in that manner.

Figure 6:
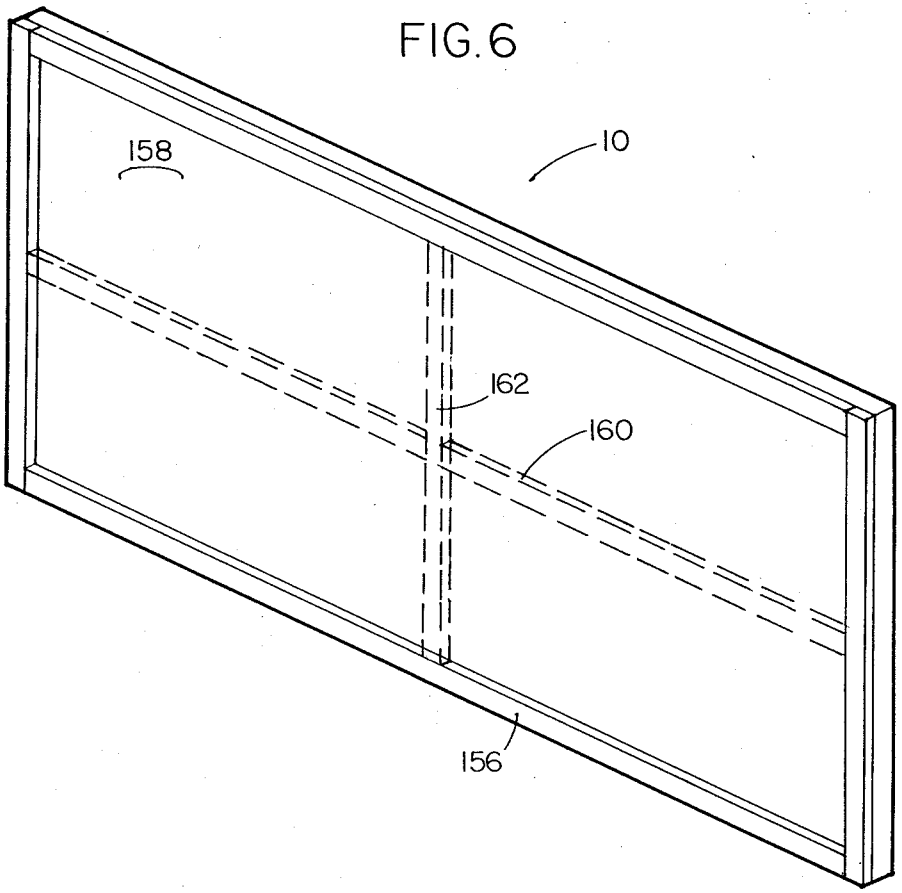
FIG. 6 is a rearward view, in perspective, of the display panel showing the location of structural support crossmembers.

FIG. 6 shows the rearward view of the display panel of the present invention. This view shows the rear of the panel without the cleats attached thereto. The rearward portion of display panel 10 has a frame section 156 extending along the outer boundary of the structural layer 158. A horizontal crossmember 160 extends lengthwise across the back of structural layer 158. A vertical crossmember 162 extends widthwise across the back of structural layer 158. The boundary frame 156, along with horizontal crossmember 160 and vertical crossmember 162, assumes much of the load-bearing forces applied to the display panel 10. These crossmembers and support structure are fastened by suitable means, such as gluing and stapling, to the back of the structural layer 158.

The display panel of the present invention offers a number of advantages not found in the prior art. First, since the entire panel is slidably removable from the wall on which it is positioned, the display panels may be easily interchanged depending upon the requirements and needs of the store using the panel. Secondly, the arrangement of slots between the slats allows the easy receipt of either slatwall accessories or shelving. The material covering the outer surface of the slats permits the attachment of signs, displays, pictures and other items. Additionally, the use of the VELCRO tape at the rearward portion of the horizontal slot allows shelves to be firmly fixed in position.

Through the use of the present invention, department stores would be able to change entire displays in a relatively short period of time. The stores would be able to adapt their facilities to the type of product being marketed. There is no need for costly permanent installation.

The present invention also is adaptable to a wide variety of various standing positions. For example, the display panel could be connected about its end caps to an adjacent display panel. The angled configuration between the separate display panels would allow the panels to rest on their lower edges without being attached to an interal wall of the store. The panels could be arranged in a triangular configuration, a square configuration, an L-shaped configuration, or a Z-shaped configuration. The present invention should not be restricted to merely being mounted on the internal wall of a store. With proper adjustments, the present invention also can be a self-standing unit.

The foregoing disclosure and description of the invention is illustrative and explanatory thereof, and various changes in the details of the illustrated apparatus may be made within the scope of the appended claims without departing from the true spirit of the invention. The present invention should be limited by the following claims and their legal equivalents.

I claim:

1. A display panel comprising:

a structural layer of rigid material;

a plurality of slat means fastened to said structural layer, said slat means having a first surface fastened to said structural layer, said slat means having a substantially planar second surface opposite said first surface, said slat means defining a horizontal slot between adjacent slat means, said slat means further comprising a dado slot extending transverse to said horizontal slot, said slat means comprising:

a block of solid wood fastened to said structural layer, said block having said dado slot formed about an edge of said block and extending longitudinally along the length of said block; and a face piece fastened to the side of said block opposite said structural layer, said face piece having a shape corresponding to said block without said dado slot; and fastening means attached to said structural layer, said fastening means for connecting said structural layer to an adjacent surface.

2. The display panel of claim 1, said slat means further comprising:

a plurality of blocks fastened to said structural layer, each of said blocks having a length generally equal to the length of said structural layer and a width equal to a fraction of the width of said structural layer, the area between said blocks forming said horizontal slot, said horizontal slot extending for the length of said structural layer.

3. The display panel of claim 4, said dado slot formed so as to communicate with said horizontal slot adjacent the forward portion of said slot, said dado slot having a height of between $\frac{3}{8}$ inch and $\frac{5}{8}$ inch, said dado slot having a width of between $\frac{1}{4}$ inch and $\frac{3}{8}$ inch.

4. The dispaly panel of claim 1, said slat means further comprising:

a cavity formed within said block, said cavity extending longitudinally along the length of said structural layer, said cavity for accomodating accessories external of said display panel.

* * * * *